US006589154B2

(12) United States Patent
Caldwell

(10) Patent No.: US 6,589,154 B2
(45) Date of Patent: Jul. 8, 2003

(54) DECANTER CENTRIFUGE WITH A GEAR BOX MOUNTED ON THE BOWL

(75) Inventor: John W. Caldwell, Glenside, PA (US)

(73) Assignee: Alfa Laval Inc., Glen Allen, VA (US)

( * ) Notice: Subject to any disclaimer, the term of this patent is extended or adjusted under 35 U.S.C. 154(b) by 0 days.

(21) Appl. No.: 09/867,715

(22) Filed: May 30, 2001

(65) Prior Publication Data

US 2002/0183186 A1 Dec. 5, 2002

(51) Int. Cl.[7] ..... B04B 1/20; B04B 9/08
(52) U.S. Cl. ..... 494/53; 494/84
(58) Field of Search ..... 494/50–54, 83, 494/84; 210/380.3

(56) References Cited

U.S. PATENT DOCUMENTS

| | | | | |
|---|---|---|---|---|
| 1,383,313 | A | | 7/1921 | Landreth |
| 1,495,075 | A | | 5/1924 | Hoyle |
| 1,563,491 | A | | 12/1925 | Hoyle |
| 1,572,299 | A | | 2/1926 | McEntire |
| 1,806,241 | A | | 5/1931 | Dupuis |
| 2,184,598 | A | | 12/1939 | Jahn |
| 2,283,457 | A | | 5/1942 | Pecker |
| 2,649,816 | A | | 8/1953 | Kuster et al. |
| 2,703,676 | A | * | 3/1955 | Gooch |
| 2,867,378 | A | * | 1/1959 | Harlow |
| 2,905,379 | A | | 9/1959 | Sticker |
| 2,919,848 | A | * | 1/1960 | Howe |
| 3,011,647 | A | | 12/1961 | Elsken |
| 3,061,181 | A | | 10/1962 | Gooch |
| 3,081,026 | A | | 3/1963 | Lacker et al. |
| 3,187,997 | A | * | 6/1965 | Gooch |
| 3,260,369 | A | | 7/1966 | Grunewaelder |
| 3,322,336 | A | | 5/1967 | Lohse et al. |
| 3,343,786 | A | | 9/1967 | Sharples |
| 3,428,247 | A | * | 2/1969 | Andresen et al. |
| 3,534,902 | A | | 10/1970 | Gilreath |
| 3,923,241 | A | | 12/1975 | Cyphelly |
| 4,327,862 | A | * | 5/1982 | Jakobs |
| 4,369,915 | A | | 1/1983 | Oberg et al. |
| 4,411,646 | A | | 10/1983 | Cyphelly |
| 5,364,335 | A | | 11/1994 | Franzen et al. |
| 5,494,579 | A | * | 2/1996 | Robatel et al. |
| 5,529,566 | A | | 6/1996 | Weil |
| 5,542,903 | A | | 8/1996 | Nishida et al. |
| 5,941,810 | A | * | 8/1999 | Gay |
| 6,056,685 | A | * | 5/2000 | Nelson |
| 6,155,964 | A | * | 12/2000 | Hensley |
| 6,387,032 | B1 | * | 5/2002 | Beyer |

FOREIGN PATENT DOCUMENTS

| | | | |
|---|---|---|---|
| DE | 30 17 158 A1 | | 12/1981 |
| FR | 2610058 | * | 7/1988 |
| IT | 401700 | | 2/1948 |
| JP | 2001-334174 | * | 12/2001 |

* cited by examiner

*Primary Examiner*—Charles E. Cooley
(74) *Attorney, Agent, or Firm*—Drinker Biddle & Reath LLP

(57) ABSTRACT

A decanter centrifuge is disclosed for separating a liquid feed mixture into constituent parts. The decanter centrifuge includes a bowl assembly mounted for rotation about a longitudinal axis. Opposite ends of the bowl assembly are rotatably supported by first and second bearings. A motor is engaged with one end of the bowl assembly for rotating the bowl about the longitudinal axis. A screw conveyor is coaxially mounted within the bowl with a conveyor shaft attached thereto. A gear box is located between the second bearing and the bowl and includes a transmission engaged to the shaft. The transmission rotates the conveyor at a relative speed with respect to the bowl. A plurality of circumferentially spaced posts mount the gear box to the bowl, spacing the gear box apart from the bowl. Effluent discharge ports on the bowl discharge effluent into the space between the bowl and the gear box.

19 Claims, 4 Drawing Sheets

DECANTER CENTRIFUGE WITH A GEAR BOX MOUNTED ON THE BOWL

FIELD OF THE INVENTION

The present invention relates to decanter centrifuges and, more particularly, to a decanter centrifuge which includes a gear box mounted to and spaced apart from a bowl.

BACKGROUND OF THE INVENTION

Decanter centrifuges are well known in the art and are commonly utilized to separate a liquid feed mixture into its constituent parts. FIG. 1 illustrates a conventional decanter centrifuge. The decanter centrifuge includes a rotating bowl 2 typically having a cylindrical portion and a frustoconical end portion. The bowl 2 is engaged to a first drive motor M1 which is generally fixed to a support or base. The first drive motor M1 rotates the bowl 2 about its longitudinal axis.

A screw conveyor 4 is rotatably disposed within the bowl 2 and includes one or more spiraled flights 5. The screw conveyor 4 is engaged with a differential box 6 which drives the screw conveyor 4 at a differential speed with respect to the bowl 2. A second motor M2 is engaged with the differential box 6 for driving the screw conveyor 4.

In operation, a liquid feed mixture or slurry is fed into the bowl 2. Rotation of the bowl 2 generates a centrifugal force on the liquid feed which separates the feed into an effluent portion and a solids portion. The terms "light phase" and "heavy phase" are sometimes employed to refer to these constituent parts. The light phase is a liquid and the heavy phase is a concentrated solids material.

The screw conveyor 4 is rotated inside the bowl by the differential box 6, usually a gear box, at a differential speed with respect to the bowl 2. As such, the flights 5 on the screw conveyor 4 push the separated heavy phase towards the conical end of the bowl 2. One or more solids discharge ports 7 are formed in the bowl 2 for discharging the heavy phase. The light phase is discharged from the bowl 2 through one or more effluent discharge ports 8, typically located at the opposite end of the bowl from the solids discharge.

As shown in FIG. 1, the bowl 2 is attached to the first drive motor M1 and the gear box 6 through hubs. The hubs extend through pillow block bearings 9 which rotatably support the bowl. A conveyor shaft extends from both ends of the screw conveyor 4. The conveyor shaft is engaged with the gear box 6. The pillow block bearings support the bowl and the screw conveyor 4.

As illustrated, both motors, as well as the gear box, are mounted outboard of the pillow block bearings. This type of conventional mounting arrangement for decanter centrifuges is generally adequate when the gear box is relatively small in comparison to the bowl size. In certain applications, however, such as with municipal waste, it is necessary to create a relatively dry heavy phase. In such applications, additional torque is needed to rotate the conveyor. This necessitates an increase in the size and weight of the gear box 6. However, increasing the size and weight of the gear box leads to strength problems with the hub 3 and lowers the natural frequency of the decanter centrifuge.

Also, the pillow block bearings in a conventional decanter are typically operating above their manufacturer-rated speed. To reduce the speed of the bearings closer to the catalog rating, it would be necessary to reduce the size of the bearing which, in turn, would require a reduction in the size of the hub 3 passing through the bearing. However, in order for the gear box to provide increased torque, the hub 3 must be large enough to transmit the torque, support the gear box, and prevent the natural frequency of the gear box on the hub from being near the bowl's operating speed. Thus, to date, the design of conventional decanter centrifuges usually involves a compromise which limits the use of the centrifuges.

SUMMARY OF THE INVENTION

The present invention is directed toward a decanter centrifuge for separating a liquid feed mixture into constituent parts. The decanter centrifuge includes a bowl assembly comprising a bowl mounted for rotation about a longitudinal axis and a differential box. The bowl assembly has first and second hubs located at its opposite ends. First and second bearings are also located on opposite ends of the bowl assembly. The first bearing rotatably supports the first hub and the second bearing rotatably supports the second hub. A first drive motor is engaged with the first hub for rotating the bowl about the longitudinal axis.

A screw conveyor is coaxially mounted within the bowl and has an attached conveyor shaft. The conveyor shaft is engaged with a differential box, often a gear box, located between the second bearing and the bowl (in this application, differential box and gear box will be used interchangeably). The gear box is adapted to rotate the conveyor shaft at a relative speed with respect to the bowl. A second motor, electrical brake, or torque arm is preferably engaged to the input shaft of the gear box.

The gear box is attached to the bowl by means of a plurality of circumferentially spaced posts. The posts fixedly position the gear box in a spaced relationship with the bowl. The space between the gear box and the bowl is preferably sufficient to minimize or prevent effluent being discharged from the bowl from washing against the gear box, and be large enough to allow an operator to change effluent dams.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE DRAWINGS

Figure 1:
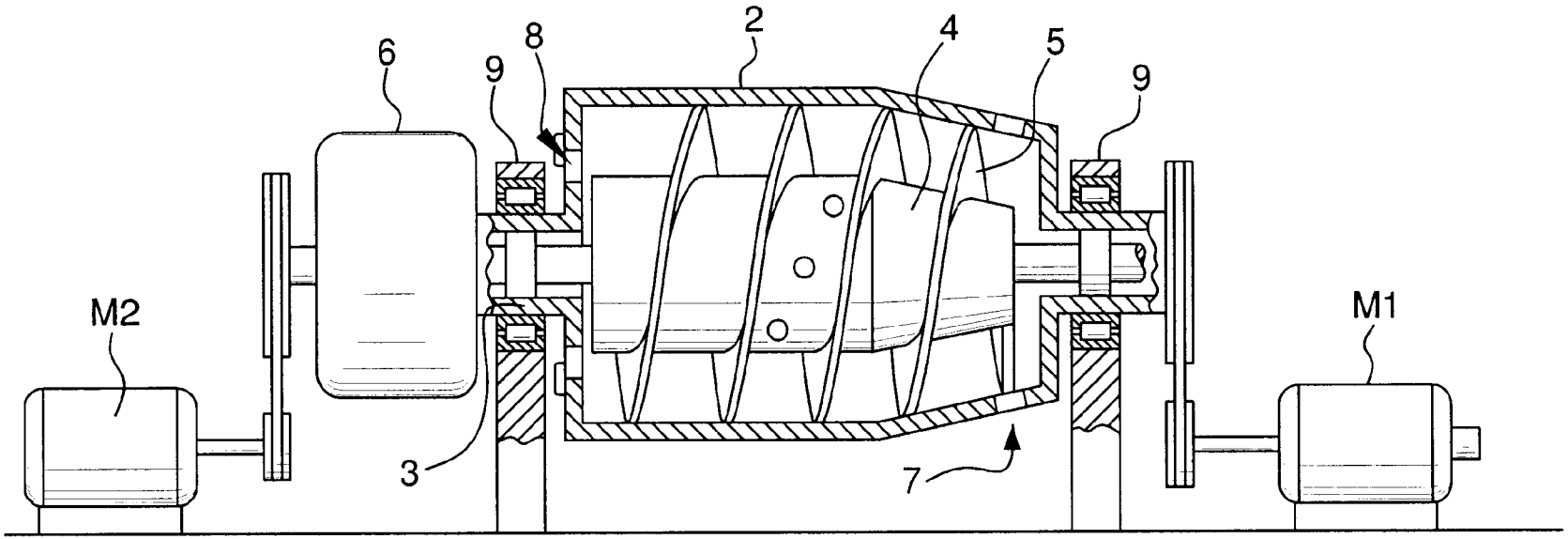
FIG. 1 (PRIOR ART)
FIG. 1 is a partial cross-sectional view of a conventional decanter centrifuge.

Referring now to figures wherein like reference numerals identify corresponding or similar elements throughout the several views, the present invention is illustrated in a configuration which is currently preferred. In particular, referring to FIG. 2, a decanter centrifuge 10 according to the present invention is illustrated which includes a bowl assembly 55 with hubs 14, 16 located at opposite ends. The bowl assembly 55 includes the bowl 12 and the differential box 32. Each hub 14, 16 is disposed in and rotatably supported by a bearing 18, such as a pillow block bearing or equivalent. The bearings 18, in turn, are each supported by the ground through resilient isolators. A first drive motor 20 is engaged with the hub 16 and rotatably drives the hub 16 and bowl 12 about a longitudinal axis.

The bowl 12 includes one or more solids discharge ports 22 located at one end for discharging the separated heavy phase during operation. Effluent discharge ports 24 (FIGS. 3 and 4) are formed in the opposite end of the bowl 12 for discharging the separated liquid or light phase material.

Figure 4:
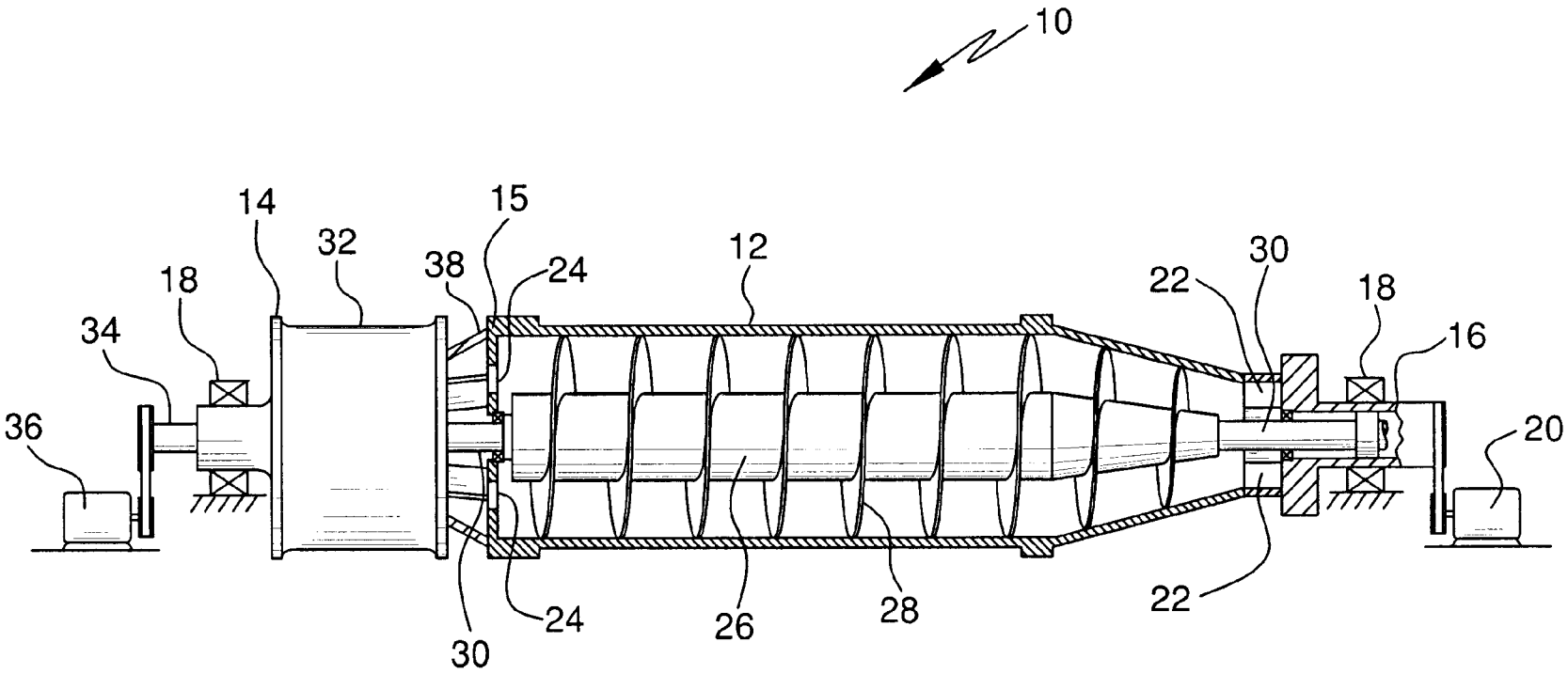
FIG. 4 is a longitudinal section view of the decanter centrifuge according to the present invention.

Referring now to FIG. 4, a screw conveyer 26 is rotatably disposed within the bowl 12 and includes a spiraled conveyor flight 28. The screw conveyor 26 is supported by a conveyor shaft 30 which extends out both ends of the conveyor 26. The conveyor shaft 30 on the solids discharge side of the bowl 12 is rotatably supported within the hub 16. The shaft may also house the feed pipe (not shown) which delivers the liquid feed material to the feed chamber.

The conveyor shaft 30 on the effluent discharge side of the bowl 12 supports the conveyor end in the bowl hub 15 and is engaged with a differential or gear box 32, which rotatably drives the conveyor shaft 30 and conveyor 26 within the bowl 12. Various types of gear boxes (and transmissions) can be used and are well known to those skilled in the art. An input shaft 34 is engaged with the opposite end of the gear box 32 and past the bearing 18. The input shaft 34 extends out of the differential box 32 and is engaged with a second motor 36, a brake, or a torque arm.

Figure 2:
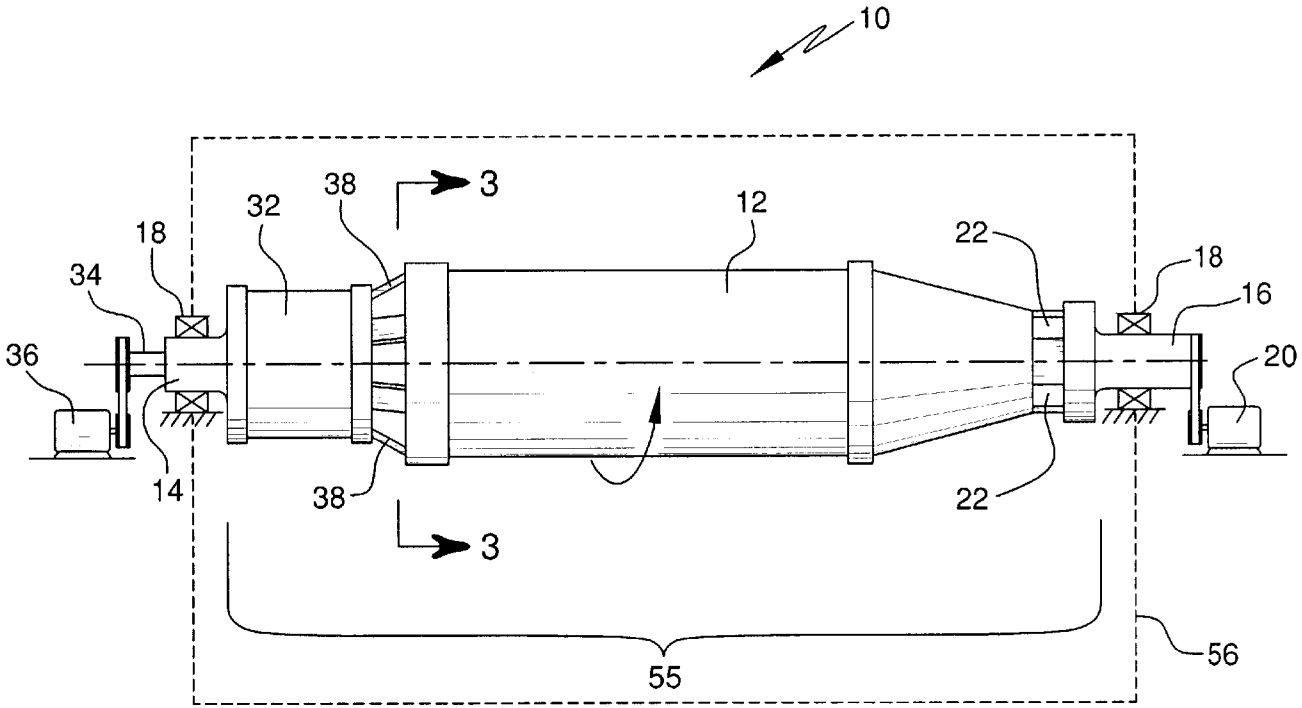
FIG. 2 is a side view of a decanter centrifuge according to the present invention.
Figure 3:
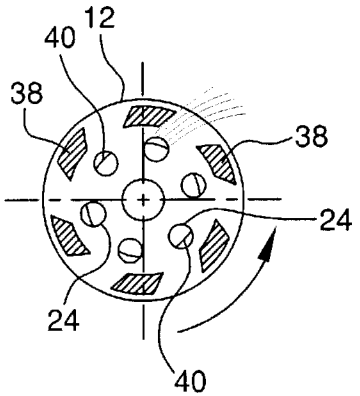
FIG. 3 is a section view along lines 3—3 in FIG. 2 illustrating the passage of the liquid effluent out of the bowl.

The gear box 32 is mounted to and supported by the bowl 12 within a non-rotating casing 56 through a plurality of circumferentially spaced posts 38 (see FIGS. 2 and 3). The posts 38 space the gear box 32 from the bowl 12. The effluent passes out of the effluent discharge ports 24. This spacing allows the liquid inner radius to be radially inward of the diameter of the gear box and still allow space for an operator to reach between the posts to change dams (not shown) without disassembly of the bowl 12. Many processes require optimizing the pond level. If the gear box 32 were attached directly to the bowl 12 without posts with such a pond level, liquid would exit through passages in the bowl hub 15 after passing over dams on the inside of the hub. Bowl disassembly would be required to change dams. Preferably the posts 38 are of sufficient length to locate the gear box 32 at a sufficient distance from the effluent discharge ports 24 to prevent the effluent from washing against the gear box 32. Such washing would have the effect of wasting energy.

The posts 38 attach to the gear box 32 at a substantial radial distance from the longitudinal axis of the bowl 12 creating a relatively strong support for the gear box 32. As a result, a larger gear box 32 can be used, thereby increasing the amount of torque that can be transmitted to the bowl 12. Also, since the gear box 32 in the present invention is located on the bowl side of the bearing 18, the vibratory concerns that are normally associated with mounting the gear box on the opposite side of the bearing support are eliminated.

A benefit of the present invention is the ability to generate a liquid pond (the cylindrical retained pool of material on the rotating bowl of the operating centrifuge) that is deeper than would normally be possible. The pond depth can be increased since only the conveyor shaft 30 passes through the bowl hub 15. Prior centrifuges required large trunnions within the hub to support a large gear box. The trunnions create a radial inward limit for the pond. A further benefit provided by the present invention is that the rotation of the gear box 32 in combination with the bowl 12 within the centrifuge casing 56 permits air to circulate around the gear box 32, thereby providing a cooling effect. Furthermore, since the gear box 32 is attached directly to the bowl 12, it provides a very strong support for the second motor 36, eliminating the need for jack shafts in side-mounted back drives.

The gear box 32 is attached to the bowl 12 and will rotate in combination with the bowl 12. As shown in FIG. 3, the motion of the bowl 12 will cause the liquid effluent discharging from the ports 24 to flow radially outward. To prevent the effluent from impacting the posts 38, it is preferable that the ports 24 be placed so that the effluent passes between the posts as illustrated in FIG. 3.

The frame in the present invention would also be made longer between pillow block supports, thereby allowing the frame beams to be made full height for the entire length of the rotating portion, increasing the natural frequency of the frame.

Figure 5:
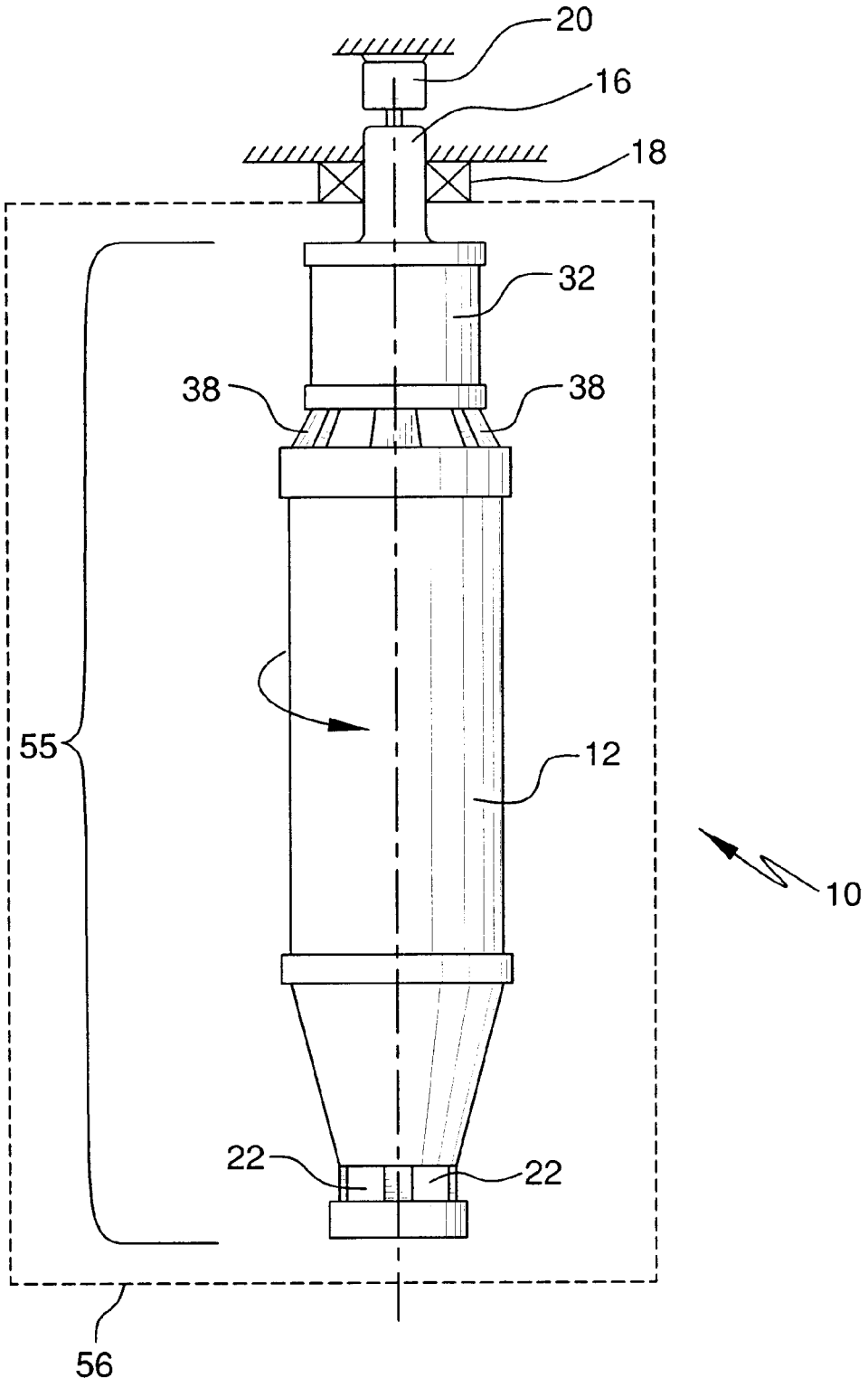
FIG. 5 is a side view of a decanter centrifuge according to the present invention.

In a vertical configuration of the decanter centrifuge shown in FIG. 5, the bowl is usually suspended like a pendulum with the gear box 32 at the top, supported by a bearing cartridge above it. The bowl 12 is generally attached directly to the underside of the gear box 32, and the lower end of the bowl is unguided by any bearing, with the solids discharge 22 usually at the bottom. Drives 20 for both bowl and gear box input are at the top of the gear box. In such a decanter when it is required that dams be replaceable without bowl disassembly, the minimum diameter of the pond has been limited by the outside diameter of the gear box. When a deeper pond is required, the liquid discharge dams are on the inside of the bowl, with the liquid exiting through passages in the bowl hub. Changing dams requires bowl disassembly. With the present invention of using posts between gear box and bowl, the inward limit of the liquid level in the bowl becomes the diameter of the conveyor shaft. Dams at the liquid discharge openings would be changed without disassembling the bowl.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. A decanter centrifuge comprising:

a bowl assembly mounted for rotation about a central longitudinal axis, the bowl assembly including a bowl and a gear box, the bowl assembly having first and second hubs located at opposite ends;

first and second bearings located on opposite ends of the bowl assembly, the first bearing rotatably supporting the first hub and the second bearing rotatably supporting the second hub;

a first drive motor engaged with the first hub for rotating the bowl assembly about the longitudinal axis;

a screw conveyor coaxially mounted within the bowl, the screw conveyor having a conveyor shaft attached thereto;

wherein the gear box is located between the second hub and the bowl, the gear box engaging the conveyor shaft and adapted to rotate the conveyor at a relative speed with respect to the bowl; and a plurality of circumferentially spaced posts attached to the gear box and to the bowl, fixedly mounting the gear box in a spaced relation with the bowl and rotating at least a portion of the gear box with the bowl.

2. A decanter centrifuge according to claim 1 wherein the bowl includes effluent discharge ports formed on the bowl inside the space between the bowl and the gear box, and the posts having a length that spaces the gear box a sufficient distance from the bowl to minimize the contact of effluent discharge with the gear box.

3. A decanter centrifuge according to claim 2 further comprising dams mounted to the bowl adjacent to the discharge ports for directing the flow of effluent out of the bowl and away from the posts.

4. A decanter centrifuge as claimed in claim 1, further comprising a second motor engaging an input shaft on the gear box, the second motor adapted to rotatably drive the input shaft.

5. A decanter centrifuge according to claim 1 wherein the bowl assembly is contained within a non-rotating casing, the gear box is within the non-rotating casing to permit air to circulate around at least a portion of the gear box for providing cooling of the gear box during operation.

6. A decanter centrifuge comprising:

a bowl assembly including a bowl and a gear box, the bowl assembly mounted for rotation about a longitudinal axis;

first and second bearings located on opposite ends of the bowl assembly, the first and second bearings rotatably supporting the ends of the bowl assembly;

a first drive motor engaging one end of the bowl assembly for rotating the bowl assembly about the longitudinal axis;

a screw conveyor coaxially mounted within the bowl, the screw conveyor having a conveyor shaft attached thereto;

wherein the gear box is located between the second bearing and the bowl, the gear box including a transmission engaged to the conveyor shaft, the transmission adapted to rotate the conveyor shaft with respect to the bowl; and a plurality of circumferentially spaced posts attached to the gear box and the bowl for fixedly mounting the gear box to the bowl in a spaced relationship.

7. A decanter centrifuge according to claim 6 wherein the bowl includes effluent discharge ports on the bowl for discharge of effluent into the space between the bowl and the gear box, the posts having a length that spaces the gear box a sufficient distance from the bowl to minimize contact of effluent discharged from ports with the gear box.

8. A decanter centrifuge according to claim 6 wherein the bowl includes effluent discharge ports at one end of the bowl adjacent the gear box, and further comprising moveable dams mounted to the bowl adjacent to the discharge ports, the dams directing the effluent discharge away from the posts.

9. A decanter centrifuge according to claim 6 wherein the bearings are pillow block bearings.

10. A decanter centrifuge according to claim 6 wherein the bowl assembly is contained within a non-rotating casing, the gearbox is within the non-rotating casing to permit air to circulate around at least a portion of the gear box for providing cooling of the gear box during operation.

11. A decanter centrifuge for separating a liquid feed mixture into constituent parts comprising:

a first rotating portion mounted for rotation about a longitudinal axis, the rotating portion including a bowl and gear box fixedly mounted to one another by a plurality of circumferentially spaced posts, the posts spacing the gear box apart from the bowl, the gear box including a transmission;

first and second bearings located on opposite ends of the first rotating portion, the first and second bearings rotatably supporting the opposite ends of the rotating portion, outwardly of the bowl and gear box, respectively;

a first drive motor engaged with one end of the first rotating portion for rotating the first rotating portion about the longitudinal axis; and a second rotating portion coaxially mounted within the bowl of the first rotating portion, the second rotating portion including a screw conveyor and a conveyor shaft attached to the screw conveyor, the conveyor shaft supported by bearings at both ends of the bowl, the conveyor shaft engaged to the transmission, the transmission adapted to rotate the second rotating portion at a relative speed with respect to the bowl of first rotating portion.

12. A decanter centrifuge according to claim 11 wherein the bowl includes effluent discharge ports at one end of the bowl facing the gear box, the posts having a length that spaces the gear box a sufficient distance from the bowl to minimize contact between the gear box and the effluent discharged out of the discharge ports.

13. A decanter centrifuge according to claim 11 wherein the bowl includes effluent discharge ports, the centrifuge further comprising dams mounted to the bowl adjacent to the discharge ports for directing flow of effluent out of the bowl and away from the posts.

14. A decanter centrifuge according to claim 11 wherein the first and second bearings are pillow block bearings.

15. A decanter centrifuge for separating a liquid feed mixture comprising:

a first rotating portion mounted for rotation about a longitudinal vertical axis, the first rotating portion having a supported end, the first rotating portion including a bowl and a differential box fixedly mounted to each other by a plurality of circumferentially spaced posts, the posts spacing the differential box apart from the bowl;

a first bearing located at the top end of the first rotating portion to support the first rotating portion above the bowl and the differential box;

a first drive motor engaged with the supported end of the first rotating portion;

a second rotating portion coaxially mounted within the bowl of the first rotating portion, the second rotating portion including a screw conveyor and a conveyor shaft supported by a bearing at the top of the conveyor shaft, the conveyor shaft engaged to the differential box adapted to rotate the second rotating portion at a relative speed with respect to the bowl of the first rotating portion.

16. The decanter centrifuge according to claim 15 wherein the bowl includes effluent discharge ports at one end of the bowl facing the differential box, the posts having a length that spaces the differential box a sufficient distance from the bowl to minimize contact between the differential box and the effluent discharged out of the discharge ports.

17. The decanter centrifuge according to claim 15 wherein the bowl includes effluent discharge ports, the decanter centrifuge further comprising dams mounted to the bowl adjacent to the discharge ports for directing flow of effluent out of the bowl and away from the posts.

18. A decanter centrifuge comprising:

a bowl assembly including a bowl and a gear box, the bowl assembly mounted for rotation about a vertical longitudinal axis, the bowl having a top end;

a screw conveyor coaxially mounted within the bowl, the screw conveyor having a conveyor shaft attached thereto, the screw conveyor having a top end;

wherein the gear box is mounted adjacent to the bowl, the gear box including a transmission engaged to the conveyor shaft, the transmission adapted to rotate the conveyor shaft with respect to the bowl;

a first bearing located at the top end the bowl assembly to support the bowl and the gear box;

a second bearing located at the top end of the screw conveyor to support the screw conveyor;

a first drive motor engaging one end of the bowl assembly for rotating the bowl assembly about the vertical longitudinal axis; and a plurality of circumferentially spaced posts attached to the gear box and the bowl for fixedly mounting the gear box to the bowl in a spaced relations.

19. A decanter centrifuge comprising:

a bowl assembly mounted for rotation about a central axis, the bowl assembly including a bowl and a gear box, the bowl assembly having a hub located at an end of the bowl;

a bearing located on an end of the bowl assembly, the bearing rotatably supporting the hub;

a drive motor engaged with the hub for rotating the bowl assembly about its axis;

a screw conveyor coaxially mounted within the bowl, the screw conveyor having a conveyor shaft attached thereto;

the gear box located between the hub and the bowl, the gear box engaging the conveyor shaft and adapted to rotate the conveyor at a relative speed with respect to the bowl; and a plurality of circumferentially spaced posts attached at opposite ends to the gear box and the bowl, the posts fixedly mounting the gear box in a spaced relation with the bowl and rotating at least a portion of the gear box with the bowl.

* * * * *